US006581895B1

(12) United States Patent
Pleasant

(10) Patent No.: US 6,581,895 B1
(45) Date of Patent: Jun. 24, 2003

(54) DISPLAY STAND

(76) Inventor: Rodney W. Pleasant, 28860 Selfridge Dr., Malibu, CA (US) 90265

( * ) Notice: Subject to any disclaimer, the term of this patent is extended or adjusted under 35 U.S.C. 154(b) by 0 days.

(21) Appl. No.: 09/747,448

(22) Filed: Dec. 20, 2000

(51) Int. Cl.[7] ..... A47G 1/14
(52) U.S. Cl. ..... 248/459; 248/174; 248/166
(58) Field of Search ..... 248/459, 174, 248/166; D22/113

(56) References Cited

U.S. PATENT DOCUMENTS

| | | | | | |
|---|---|---|---|---|---|
| 631,520 | A | * | 8/1899 | Dalsheimer | |
| 2,715,287 | A | * | 8/1955 | Birch | 40/152.1 |
| 2,992,500 | A | * | 7/1961 | Hayhow | 40/120 |
| 3,876,175 | A | * | 4/1975 | Roberts | 248/467 |
| 4,509,712 | A | * | 4/1985 | Moller | 248/464 |
| 4,512,541 | A | * | 4/1985 | Lietzke | 248/459 |
| 4,706,805 | A | * | 11/1987 | Becher | 206/144 |
| 4,773,173 | A | * | 9/1988 | Christian | 40/152.1 |
| 4,977,697 | A | * | 12/1990 | Genick | 40/539 |
| 5,165,649 | A | * | 11/1992 | Neumann et al. | 248/459 |
| 5,277,388 | A | * | 1/1994 | Denaro | 248/152 |
| D386,686 | S | * | 11/1997 | Alico et al. | D9/433 |
| 6,220,555 | B1 | * | 4/2001 | Chase | 248/174 |
| 6,237,887 | B1 | * | 5/2001 | Banner | 248/459 |
| 6,257,584 | B1 | * | 7/2001 | Nasuti | 273/407 |

* cited by examiner

*Primary Examiner*—Leslie A. Braun
*Assistant Examiner*—Ingrid Weinhold
(74) *Attorney, Agent, or Firm*—Frank L. Zugelter

(57) ABSTRACT

Display stands (20-1, 20-2, 20-3) readily adaptable for target shooting or other useful display purposes, formed and fabricated in their corresponding. patterns (P-1, P-2, P-3) formed from corresponding sheets (S-1, S-2, S-3) of corrugated paper or cardboard. Their corresponding facing members (24, 55, 72) are supported by corresponding flaps or panels (28, 54, 77) while their respective stands (20-1, 20-2, 20-3) are stabilized in a stationary manner by application of wings or straps (30), by wings or straps (58), or by struts or braces (70), respectively. The pairs of wings (30, 58) are fastened together by their respective tabs (36, 65) inserted through corresponding holes (34, 64) in their corresponding wings (30, 58) in the assembling of stands (20-1, 20-2). Niches (78) at the terminal ends (74) of struts (70) in stand (20-3) engage edges (79) of a slot (80) in FIGS. 11–17. Ears(38, 57, 82) with spikes (44) therethrough, provide an additional assist to stationarily position the supports (28, 54, 77) on soft soil or the like.

4 Claims, 3 Drawing Sheets

20-1
P-1
S-1

20-3
P-3
S-3
22
70
71
72
73
74
75
76
77
78
79
80
82

DISPLAY STAND

TECHNICAL FIELD

This invention relates to a display stand, and more particularly to a target stand for guns, projectiles, and the like.

BACKGROUND TO THE INVENTION

Although the art is filled with many portable or stationary stands on which a display is mounted, and particularly with regard to a portable stationary target stand, the force of a bullet, projectile , or other moving force from some. means, reacts with the material of the stand such that the stand moves, or is dislocated from its standing position, and in many instances, is overturned or upturned. Damage occurs, or the stand may no longer be serviceable, or delay results in repositioning the stand for further use. Another disadvantage in the art is the cumbersomeness of assembling and disassembling target and other display stands because of their complexities of parts and their interrelationships, and, without printed instructions, in many instances, the ability to assemble and disassemble the stand is reduced or eliminated.

This invention provides a stand readily assembled and disassembled and firmly stabilized in its display mode, and on which a display can be mounted, irrespective of the nature of the display, whether a target or other pictorial or written illustration of display.

SUMMARY OF THE INVENTION

The invention is directed to a display stand, in general, and particularly with regard to a target use, each well known in the art. The stand is formed from a corrugated or cardboard sheet out of which all elements of the stand are generated by cutting and scoring the sheet into a pattern constituting the unassembled yet fabricated display stand that is thee subject matter of this invention. The pattern includes a facing member on which a display, such as a target or other article, can be mounted, and a pair of flaps or panels disposed along the side edges of the facing member in the pattern, the flaps or panels being scored so as to be foldable into their corresponding positions in the stand's display mode along the bottom of or a long the side edges of the facing member so as to provide support when the stand is erected and placed in a stationary location in a three-dimensional stature. A wing or strap, or strut or brace, is formed from each of such flaps or panels, as by scoring and cutting of or in the pattern. They are either cut away in their corresponding patterns from side edges forming the facing member or cut out and scored of the interior bodies of the flaps or panels, so that in assembling of the stand they are foldable into position behind the rear of their facing member. With wings or straps, they overlap one another in the erection or assembly of the stand, and a pair of holes spaced from each other is formed, as by cutting or punching out of the material of one of the wings or straps. A pair of tabs spaced from one another is formed, as by punching or scoring out of the sheet material, in the other wing or strap, so that in the overlapping of one wing or, strap to the other, the tabs fasten to their corresponding holes in the other wing or strap, thus positioning in a stationary manner the flaps or panels in their positions relative to the facing member, and providing stabilization of the stand in a three-dimensional stature. Ears are provided in the flaps or panels, as by scoring and cutting of the material thereof, to provide means for a spike or other member that connects the assembled stand to a table, soil (such as, for example, desert soil), or other mounting surface to which the stand is put and placed, thereby preventing forces of uncontrollable means to overturn or upturn the stand from its stationary location.

The form and body formations of the struts or braces are scored and cut out of panels and extend to the rear of the facing member, to engage or hook to the facing member, thereby providing stabilization for the display stand.

A primary object of this invention is to provide target practice by gun users with an inexpensive, portable, yet firmly and solidly stationed stand at one location in use, such as a target shooting area.

Another object of this invention is to provide a portable, light-weight stand, easily assembled from and disassembled to a flat-like configuration, whether for target or for other display purposes.

Yet another object of this invention is to provide a display stand that is permanently positioned in at stationary location and thereby not subject to overturning by a force of impact directed upon it by an uncontrollable means.

A further object of the invention is to provide a display stand formed or fabricated from a single piece of material.

A still further object of the invention is to provide for the production of mass quantities of a display stand at minimal or inexpensive cost.

These and other objects and advantages of the invention will become more apparent by a full and complete reading of the following description, its appended claims, and the accompanying drawing comprising three sheets of seventeen (17) FIGS.

DESCRIPTION OF THE PREFERRED EMBODIMENT

Figures 1, 2, 3, 4, 5, 6:
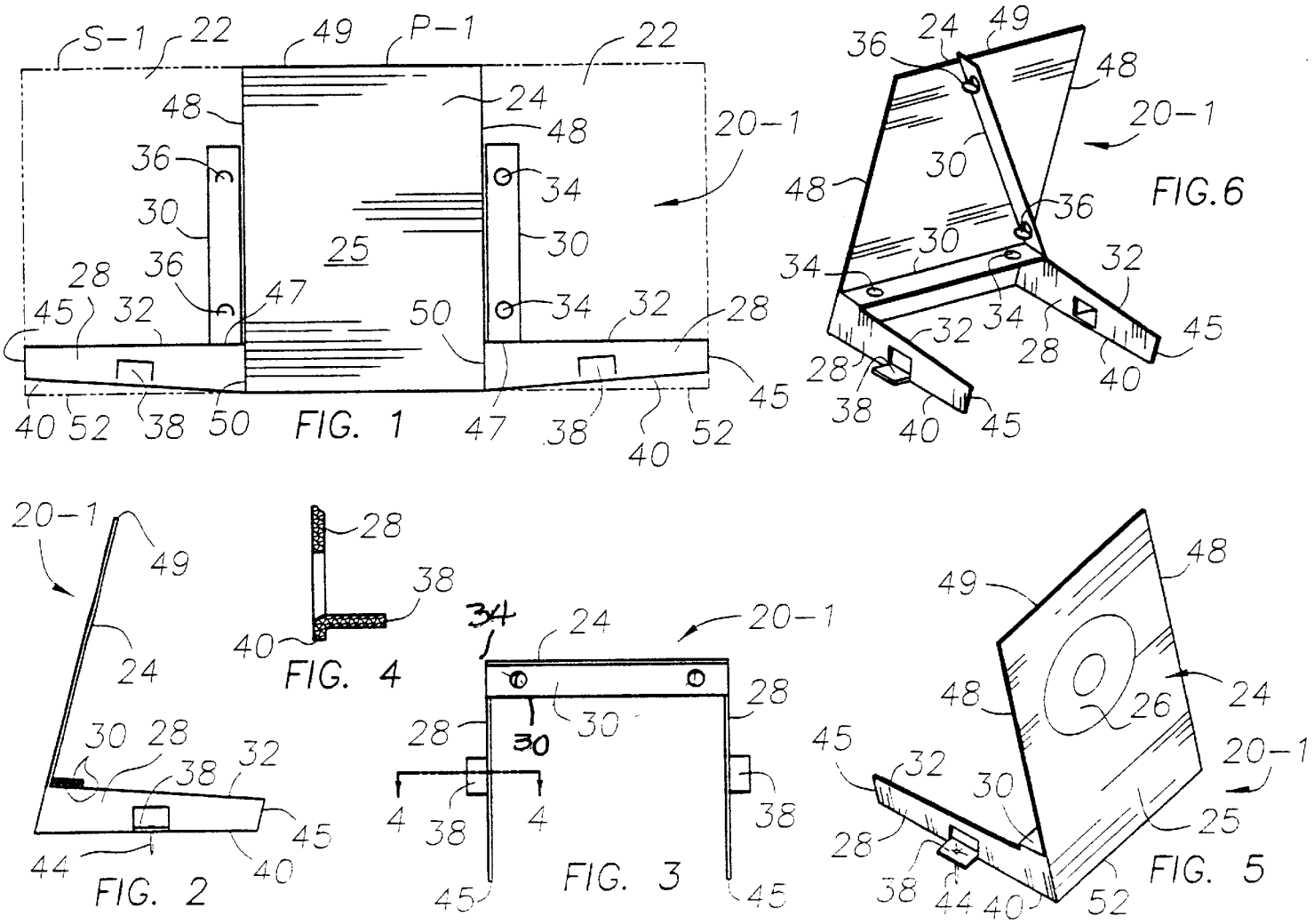
FIG. 1 is a plan view of a.single sheet of material from which a pattern of the subject matter of this invention, illustrated in scored and cut elements, is generated.
FIG. 2 is an elevational view taken from one side of an assembled stand of this invention.
FIG. 3 is a plan view of the subject matter of FIGS. 1 and 2.
FIG. 4. is a cross-sectional view taken along line 4—4 of FIG. 3.
FIG. 5 is a perspective illustration of the invention's display stand, with target in its assembled mode, viewed from an elevated and left front point of view.
FIG. 6 is a perspective illustration of the fabricated display stand of this invention, in a partial assembly/disassembly mode, viewed from an elevated and left rear point of view.

Turning now to the FIGURES of the drawing wherein reference characters correspond to like numerals hereinafter, single sheets S-1, S-2, S-3, FIGS. 1, 7, 11, respectively, of suitable material, such as corrugated paper or cardboard, are shown by the phantom outlines (rectangular, in these embodiments) in these FIGS. Patterns P-1, P-2, P-3 FIGS. 1, 7, 11, respectively, for unassembled display stands 20-1, 20-2, 20-3 of this invention are respectively generated from each of these three sheets S-1, S-2, S-3. Segments 22 in each of these sheets S-1, S-2, S-3 do not constitute part or parts of these display stands 20-1, 20-2, 20-3. The segments 22 are ultimately discarded, whether before or after the display stands have materialized from their corresponding patterns.

Referencing firstly FIGS. 1–6, display stand 20-1 is configured as a facing member 24 having a frontal face 25 for display of a target 26, FIG. 5, or other suitable display, a pair of supporting flaps or panels 28 by which display stand 20-1 is supported for erection or stand-up for a display of target 26 on a suitable supporting surface (not shown), such as on a table, shelf, flat member, or on the ground in a suitable safe, environmental area where target shooting is undertaken, or the like. Each of a pair of wings or straps 30 extends from a top edge 32 of its corresponding flap or panel 28, for overlapping one another in the assembly of stand 20-1. The one wing or strap 30 includes a pair of spaced holes 34 along its length, while the other wing or strap includes in its length a pair of spaced tabs 36, FIGS. 1, 6, each of which aligns with a corresponding one of, the spaced holes 34 upon overlapping the wings or straps to one another. Tabs 36 are thrust through their corresponding holes 34 to fasten the two wings or straps 30 together and thereby maintain the supporting flaps or panels 28 in their 2 respective stationary positions relative to the facing member 24, thus stabilizing display stand 20-1. Tabs 36 are partially cut from the material forming the one wing or strap 30, having their body portions integrally remaining with the material of the pattern P-1, so that they can readily bend, in either direction, into their corresponding holes 34 upon overlapping the pair of wings or straps 30, mating both wings or straps 30 together while stationarily positioning flaps or panels 28 relative to their facing member 24.

Each supporting flap 28 includes an appendage or ear 38, FIGS. 6, scored slightly above each flap's corresponding lower edge 40, while the ears remaining edges, here three (3), are cut out from the pattern's material, so that when display stand 20-1 is assembled and is to be retained in a fixed stationary location, spikes or the like or other connecting members 44, FIGS. 2, 5, can be thrust through each of ears 38, when such ears are folded out of the plane of the material of the flaps or panels, and into a table, soil or other mounting surface on which display stand 20-1 is located or situated. The fold for ears 38 is reversible to either side of flaps or panels 28.

In forming or fabricating an unassembled display stand 20-1 from its pattern P-1, the bottom or lower edge 40, the terminal edge 45, and a portion of the top or upper edge 32, between terminal edge 45 and each wing or strap 30, of each flap 26, are formed by cutting completely through sheet S-1. However, inward portions 47, FIG. 1, of each of flaps or panels 28 are merely scored rather than cut, so that their corresponding wing or strap 30 remains integral to the panels 28. Each wing or strap 30 is further formed from sheet S-1 by cutting along the two (2) side edges 48 forming facing member 24, from the top or upper edge 49 of sheet S-1 to a point where each side edge 48 meets its flap or panel 28 at which then the side edge 48 is merely scored on line 50, FIG. 1. In this manner, both the flaps or panels 28 and the wings or straps 30 are retained as integral elements with facing member 24 thereby forming the pattern for display stand 20-1.

In the embodiment illustrated in FIGS. 1–6, the lower edges 40 of flaps or panels 28 are inclined upwardly away from a bottom edge 52 of sheet S-1, FIG. 1. Such inclination provides for a tilting orientation for facing member 24 in the assembled and displayed mode illustrated. It should be understood that the invention is not limited to a tilting of display stand 20-1 as shown, as is evident from the embodiment illustrated in FIGS. 11–17, or by flaps or panels 28 being inclined downwardly rather than upwardly as shown in the FIGURES.

Figure 8:
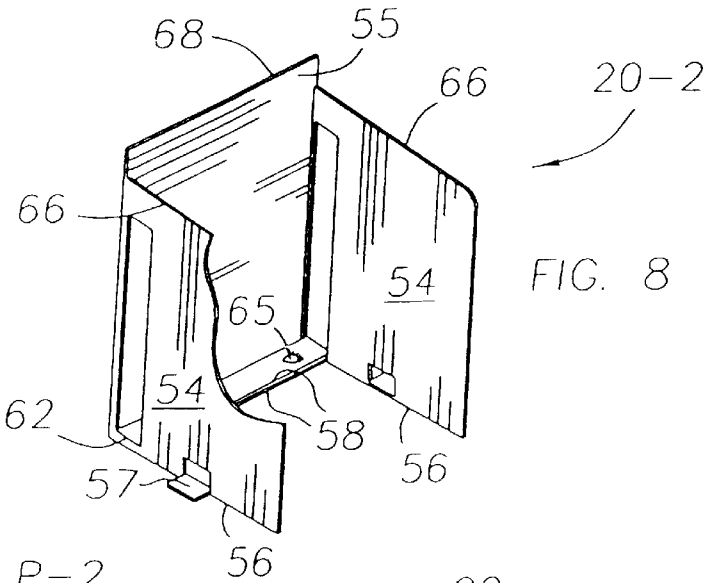
FIG. 8 is a perspective view (partially broken away) of the assembled condition for the FIG. 7 embodiment, illustrated from an elevated and left rear point of view.
Figure 7:
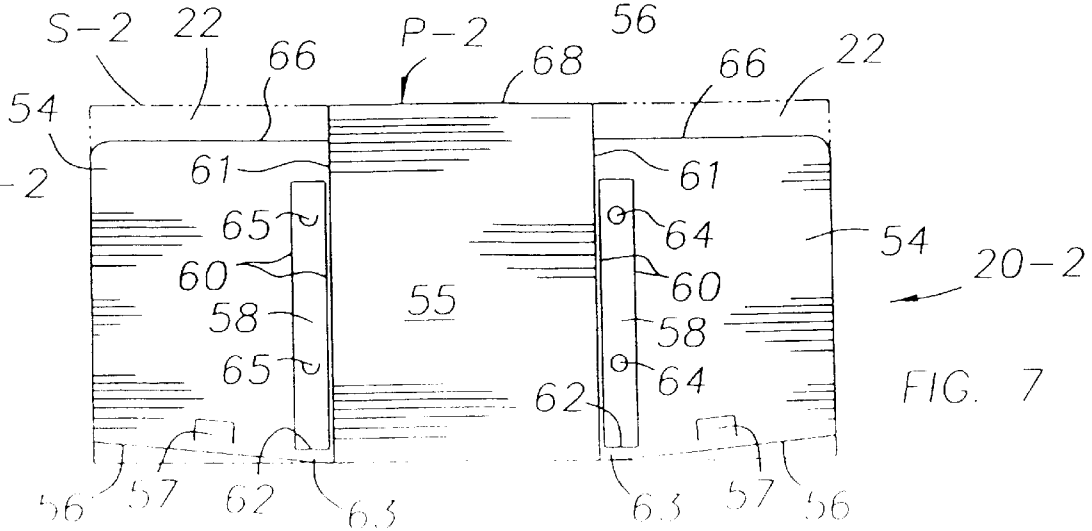
FIG. 7 is a plan view of a sheet of material on which a pattern of an alternative embodiment of the invention, including scored and cut segments, is illustrated.
Figure 9:
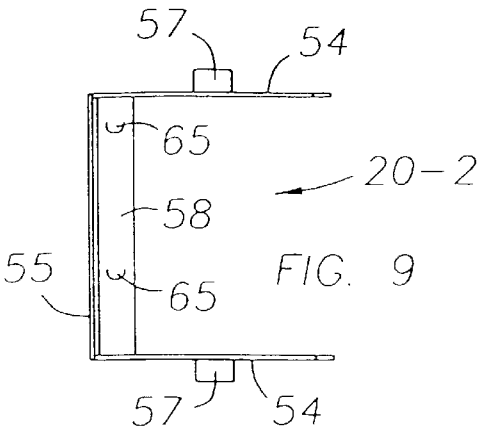
FIG. 9 is a plan view of the assembled stand of FIG. 8.
Figure 10:
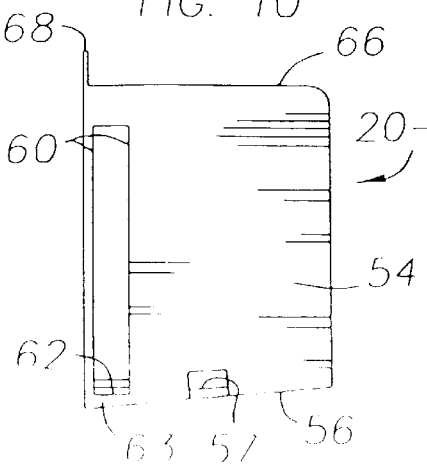
FIG. 10 is a side elevational view of the embodiment illustrated in FIGS. 8 and 9.

FIGS. 7–10 illustrate an embodiment of the invention in which substantial portions of both segments 22, FIG. 7, are retained as panels 54 of display stand 20-2, FIGS. 7, 8. Again, an inclination or tilting of the stand's facing member 55 is incorporated into the stand 20-2 by inclining bottom edges 56 of panels 54 in the same manner as is with lower edges 40 in FIGS. 1–6. Ears 57, FIGS. 7, 8, may be included. The stand s corresponding wings or straps 58 are cut and scored out of the interior of their corresponding panels 54, cutting sheet S-2 in a manner as to form their opposing side edges 60 , FIGS. 7, 10, substantially parallel to and adjacent or next to their corresponding side edges 61 of facing member 55, except for a scored line 62 along a margin 63 of the material of sheet S-2, FIGS. 7, 10, and by which wings or straps 58 retain integrity with their corresponding panels 54. Holes 64 and tabs 65 in their respective wings or straps 58 are formed and fabricated in the same manner as those illustrated in FIGS. 1–6. Top edges 66 of panels 54 are illustrated in FIGS. 7, 8 as being at a lower height than a top edge 68 of facing member 55, however, it should be understood that edges 66 and 68 may be in alignment with one another or reversed in their heights, or otherwise, than shown in the FIGURES of this embodiment.

Figures 11, 12, 13, 14, 15, 16, 17:
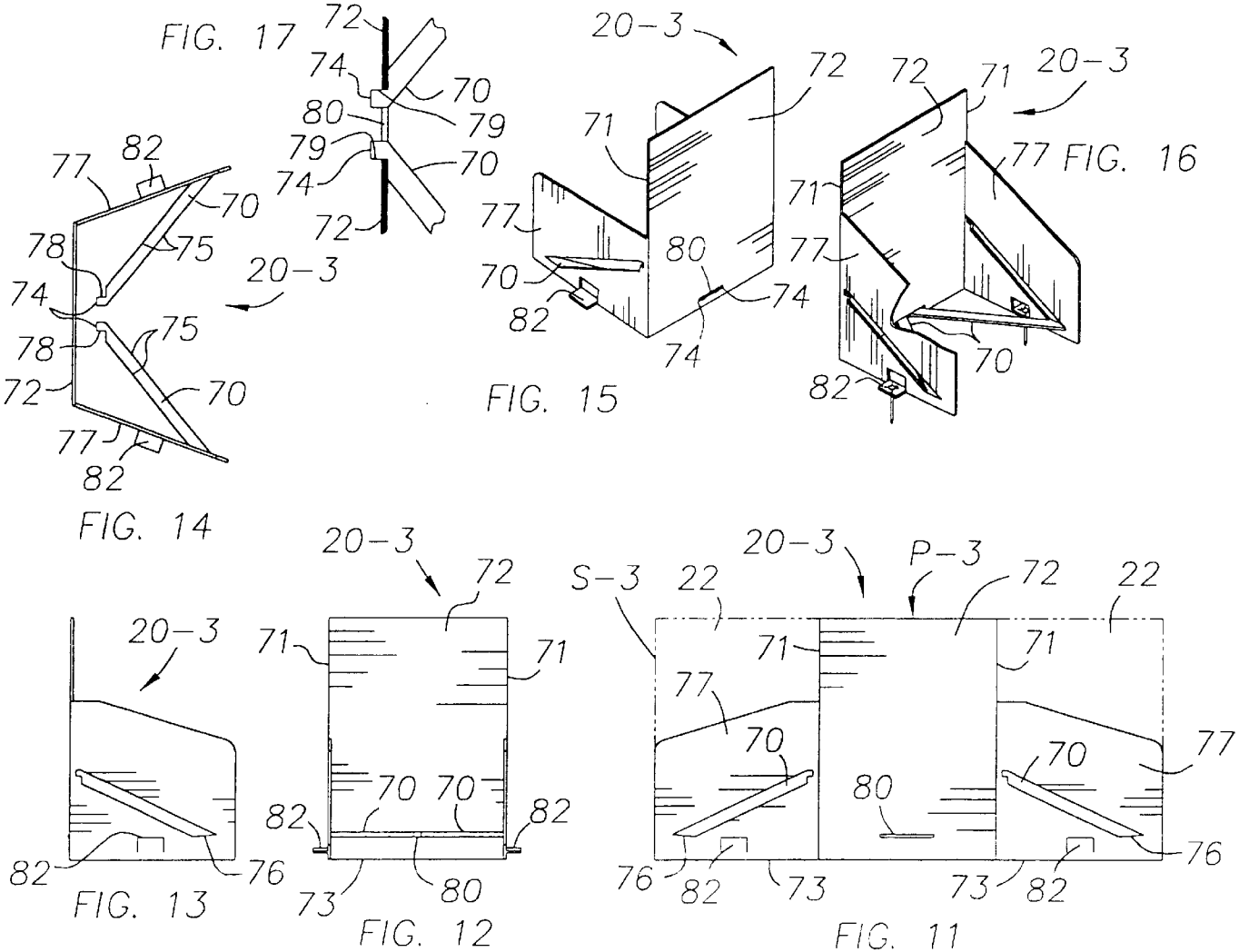
FIG. 11 is a plan view of a single sheet of material from which a pattern of another embodiment of the invention is generated, the pattern being illustrated by scored and cut elements.
FIG. 12 is a rear elevational view of the assembled stand formed from the pattern of the material illustrated in FIG. 11.
FIG. 13 is a side elevational view of the assembled stand formed from the patter of the material shown in FIG. 11.
FIG. 14 is a plan view of a:partially assembled/disassembled embodiment formed from the pattern of the material illustrated in FIG. 11.
FIGS. 15 and 16 are perspective views of the assembled stand formed from the pattern of the material of FIG. 11, illustrated respectively from elevated left and left rear points of view.
FIG. 17 is an enlarged fragmentary cross-sectional view in the illustrated embodiment of FIGS. 11–16, at the location of a slot in the stand's facing member and at which a strut or brace assists in positioning the flaps or panels for stabilizing the display stand.

Another embodiment of the invention is illustrated by stand 20-3 in FIGS. 11–17. Each of a pair of fastening struts or braces 70 in pattern P-3, FIG. 11, is not, in their formation in pattern P-3, disposed in a parallel orientation with respect to either side edges 71 of a facing member 72 or to a bottom edge 73, FIG. 11, of the pattern P-3, not like the illustration in the previously described embodiments 20-1, 20-2 of the invention. Each strut or brace 70 includes, FIG. 17, a terminal end 74 and opposing body edges 75, FIG. 14, and is formed by cutting such end and edges out of sheet S-3 or pattern P-3. Scored lines 76, FIGS. 11, 13, in pattern P-3, provide an integral connection for each of these struts or braces 70 to its corresponding panel 77. Each scored line 76 is formed generally parallel to bottom edge 73, however, each strut or brace 70 formed by its scored line 76 as it extends from its planar placement in its panel 77 displaces in an angular orientation from the direction of its corresponding scored line 76, so that as each panel 77 is assembled into a stature for display stand 20-3, the corresponding terminal end 74 of its strut or brace 70 is in a position for connection or attachment to facing panel 72. This particular step in assembly of stand 20-3 determines the swing of each panel 77 from its planar position in pattern P-3, depending on the length of each strut or brace 70. A niche 78, FIG. 14 , is formed in each strut or brace 70 along or in its corresponding edge 75, adjacent its respective strut or strap s terminal end 74, for engaging or hooking onto a corresponding end edge 79, FIG. 17, that forms a slot 80, to thereby stabilize display stand 20-3 in its assembled mode or statute by stationarily positioning flaps or panels 77. It should be understood that the illustrated planar or directional orientation of scored line 76 need not be disposed only in a direction that is parallel to bottom edge 73, as the placement and disposition of slot 80 in facing member 72 can be otherwise than as illustrated, so that when niches 78 connect to facing member 72 via slot 80, the intended stabilized stature for display stand 20-3 is achieved. It also is to be understood that an inclination for facing member 72 may be introduced into this embodiment as well as into others, by inclining bottom edges 73 of panels 77 in the same manner as in the embodiment illustrated in FIGS. 1–6. Ears 82 are included for stand 20-3 in their corresponding panels 77 in the same manner as in the previously described embodiments.

In assembly of the stands, each display stand 20-1, 20-2, 20-3, is assembled from their respective unassembled modes or conditions, which may either be completely flat as presented in FIGS. 1, 7, and 11, or with flaps (panels) and wings (straps) and/or struts (braces) folded against their respective facing members; in either case, segments 22 are not portions of the stands. The flaps and wings and struts of the respective stands 20-1, 20-2, 20-3 are then unfolded, or folded as the case may be, relative to their corresponding facing members, so as to produce three respective dimensional statures for their corresponding stands 20-1, 20-2, 20-3, i.e., from a general planar appearance in their respective unassembled modes or conditions to a processing mode or condition in assembling, and at which mode the tabs, in FIGS 11–10, fasten together the wings or straps as they are overlapped to each other, so as to provide a stabilized three-dimensional stature for stands 20-1 and 20-2; and as to stand 20-3, hooking niches 78 of each strut 70 to 79 of slot 80, thus providing a stabilized three-dimensional stature for display stand 20-3. Thereafter, each display stand is set down on a base suitable for its stationary presentation, such as with a target 26 or other display already mounted to, or to be mounted to, the stand's frontal face. Spikes 44 or the like are thrust through their corresponding appendages or ears 38, 82 in their corresponding stands to provide for fixed stationary locations for their display stands in the event their respective surrounding environments require them.

In forming and fabricating each display stand 20-1, 20-2, 20-3 the patterned material is preferably formed of cardboard or corrugated paper. The paper corrugations preferably extend in a direction from the bottom to the top of each display stand, providing more strength and life to the stands than were the corrugations disposed otherwise in sheets S-1, S-2, S-3. The scoring and cutting steps required to form the above described elements of the display stands in any one of its embodiments, are well known techniques in the manufacture of corrugated paper and cardboard assemblies or articles and other fabricated packages.

Various modifications of display stands 20-1, 20-2, 20-3 are available to the disclosures of the heretofore embodiments and to other embodiments of the invention, without departing from its scope or spirit as set forth in the appended claims hereto. For example, without being limited thereto, the flaps (panels) 28 and the wings (straps) 30 need not be of the same length to each other in a display stand, as long as one pair or more of aligned holes 34 and tabs 36 therein in a display stand mate for fastening to each other to produce the stabilized assembly in accordance with the disclosure of this invention. Similarly, the struts (braces) 70 need not necessarily be of the same length to each other nor lie in the same plane with one another. The top edge of the facing members 24, 55, 72 may be at the same height as the height of its corresponding panel 28, 54, 77, or even below the panels' heights. The extension members in the forms of the flaps, panels, struts or braces can extend from points or attachments on their corresponding flaps or panels other than illustrated in the drawing. The height or location (horizontally or otherwise) of slot 80, or a plurality thereof, within the width of a facing member is not limited to the position illustrated in the drawing. The facing member that is illustrated has the aspect of a planar element, and it should be understood that the facing member may be constituted as a curvi-linear construction or appearance as well, i.e., that itself can be formed in its construction or appearance within a third-dimension as well as being formed in construction and appearance in the planar dimensions as illustrated in the drawing.

I claim:

1. In a display stand having a facing member on which a display can be mounted and means displaced in a third dimension behind the facing member for supporting said facing member in a display mode and in combination with means for stabilizing in a stationary location said display stand in the completion of assembly of the stand by maintaining said supporting means in a stationary position, said facing member including slot means, the improvement wherein said stabilizing means comprises a first strut having a terminal end and extending from a first one of said supporting means to said slot means, a second strut having a terminal end and extending from a second one of said supporting means to said slot means, means on each said terminal end for engaging said slot means to thereby stabilize said stand by providing stationary positioning for said first and second ones of said supporting means.

2. In the improvement of claim 1, said engaging means comprises a niche adjacent each said terminal end.

3. The display stand of claim 1 wherein said facing member is of a curvilinear construction.

4. The display stand of claim 2 wherein said facing member is of a curvilinear construction.

* * * * *